United States Patent [19]

NeSmith

[11] 4,291,858

[45] Sep. 29, 1981

[54] CLIP APPARATUS FOR CONCRETE FOUNDATION FORMS

[76] Inventor: Kenneth L. NeSmith, 12936 E. Galveston, Chandler, Ariz. 85224

[21] Appl. No.: 153,071

[22] Filed: May 27, 1980

[51] Int. Cl.[3] ..... E04G 17/00

[52] U.S. Cl. ..... 249/216; 249/219 R

[58] Field of Search ..... 249/210, 216, 219 R

[56] References Cited

U.S. PATENT DOCUMENTS

| | | | |
|---|---|---|---|
| 972,036 | 10/1910 | Sullivan | 249/219 R X |
| 2,711,573 | 6/1955 | Bliss | 249/110 X |
| 2,727,294 | 12/1955 | Airighini | 249/219 R X |
| 3,374,984 | 3/1968 | Mueller | 249/216 |
| 3,525,495 | 8/1970 | Brosseau | 249/219 R X |
| 4,185,804 | 1/1980 | Baculo | 249/219 R X |

*Primary Examiner*—J. Howard Flint, Jr.
*Attorney, Agent, or Firm*—H. Gordon Shields

[57] ABSTRACT

Clip apparatus for spacing apart and holding together concrete forms includes a single wire base strut and a pair of transversely reinforced and generally vertically extending end arms with intermediate arms, for spacing the foundation forms, for holding the forms together while concrete is poured into the forms and while the poured concrete is curing.

16 Claims, 15 Drawing Figures

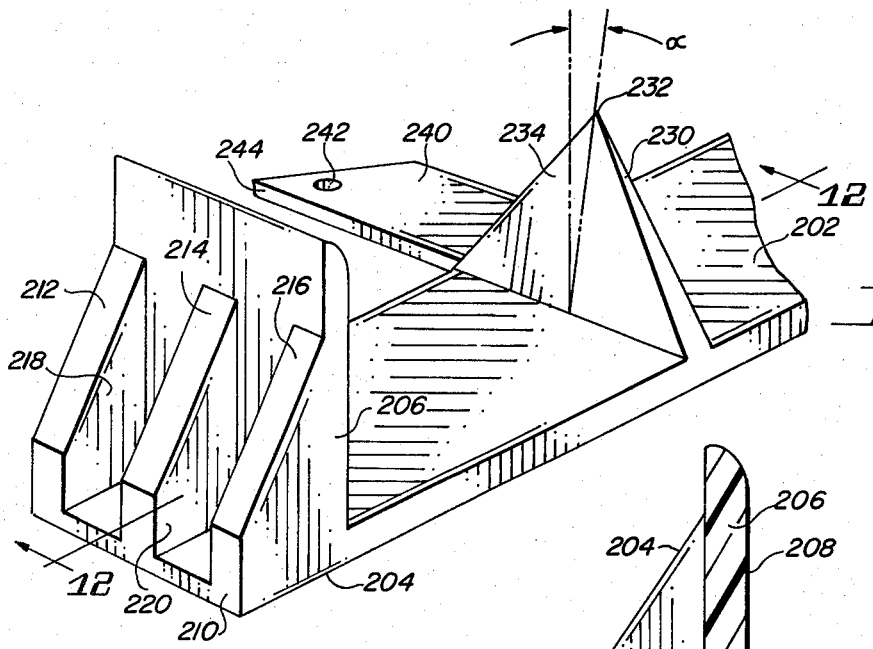
FIG. 11
FIG. 13
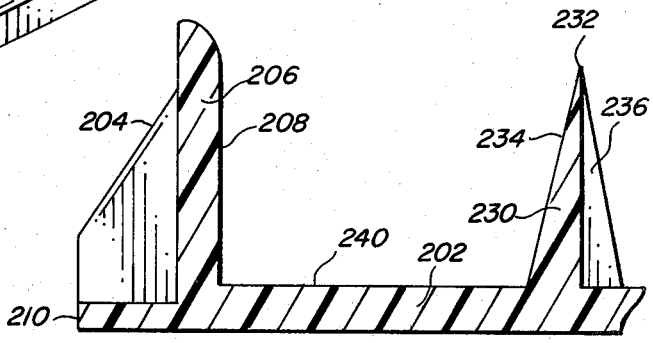
FIG. 12
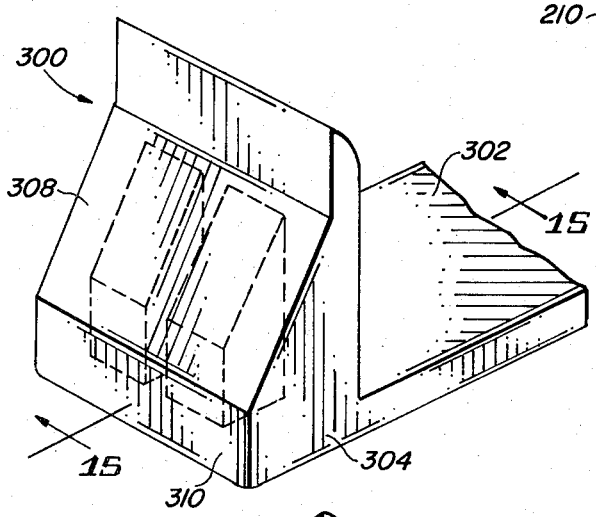
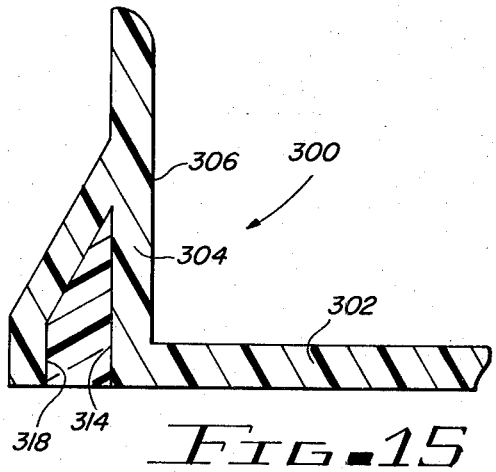
FIG. 15
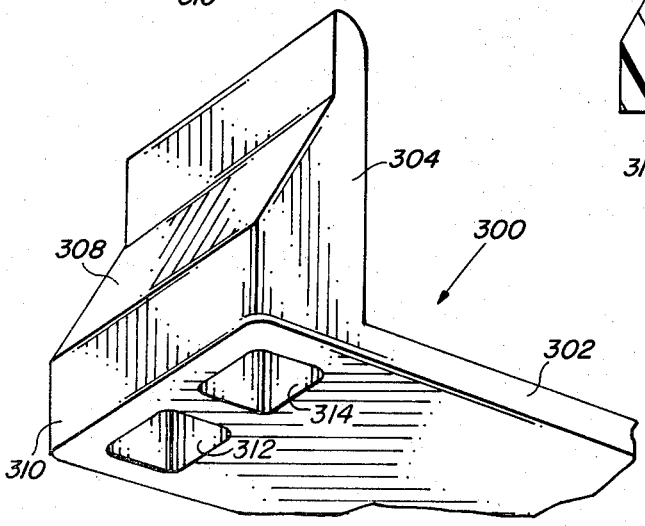
FIG. 14

CLIP APPARATUS FOR CONCRETE FOUNDATION FORMS

BACKGROUND OF THE INVENTION

1. Field of the Invention

This invention relates to clips for securing together forms, and, more particularly, to clips for securing together foundation forms spaced apart a predetermined distance, and into which forms concrete is to be poured.

2. Description of the Prior Art

In typical construction, whether the construction be residential buildings or office buildings, or the like, concrete footings are usually poured into a trench dug for the specific purpose of receiving the footing. Footings are poured for the outside walls and inside bearing walls. On top of the footings for the perimeter walls is a concrete stem, typically about eighteen or more inches high. Wooden forms are first prepared into which concrete material will be poured for the stem. The forms comprise a pair of walls spaced apart a predetermined distance from each other, depending on the desired width of the stem.

There are several methods for spacing the concrete forms and for positioning the forms. One method is to use stakes driven into the ground at the outside of the forms. The stakes may be wood or metal. The forms are then supported vertically by the stakes. To insure that the forms do not spread apart at the top or at the bottom, wooden cleats may be nailed in place to insure that the form walls remain vertically oriented, or metal straps or posts may be secured to the forms for the same purpose. These staking methods obviously require a substantial amount of manual work. If wooden stakes and wooden cleats are used, additional time is required for nailing the elements together and for measuring the distances to insure that the proper width between the forms is maintained.

Another method, and one which is more economical with respect to the time involved, and more accurate, is to use clips to secure the forms together at the bottom of the forms and also at the top of the forms. An example of clip apparatus usable for this purpose is found in U.S. Pat. No. 2,973,567. The clip disclosed in the '567 patent comprises a metal strap with a pair of vertically extending and parallel end pieces. The strap and the end pieces are unitary, made of a single piece of metal, such as steel strap, with the end pieces extending from, or bent perpendicular to, the base portion. Spaced apart a predetermined distance from the end pieces are a pair of inner tabs or wings. The tabs or wings comprise angular perforations punched from the base and oriented upwardly with respect to the base portion. The forms are spaced between the respective inner tabs and end pieces. The distance between the inner tabs or wings is, of course, the width of the stem.

An alternate clip apparatus is disclosed in U.S. Pat. No. 3,547,397. The '397 apparatus discloses a clip made from wire. The clip includes a pair of parallel wire base elements with a pair of vertically extending end pieces. The clip, from the top or bottom, appears in the general configuration of a rectangle. From either end, the clip appears to be of a generally triangular configuration because the end pieces extend upwardly and inwardly at about a forty-five degree angle. The clip is preferably made of a single piece of wire. Space inwardly from the end pieces are a pair of inner supports, also made of wire. The foundation forms are disposed between the end pieces and the inner supports spaced inwardly from the end pieces.

An alternate embodiment of the '397 clip is also shown. The alternate embodiment includes a downwardly recessed portion into which the forms are disposed, which eliminates the separate wire elements spaced apart on the end pieces. In this manner the entire clip is made from a single length of wire.

Once the stem is poured, it is obvious that the clips disposed at the bottom of the forms may not be removed from the stem after the concrete is cured. Accordingly, the bottom clips remain in place and essentially are a part of the foundation. The top clips are removed to allow the forms to be removed from the partially cured concrete stem. Since roughly half of the clips are expendable, the cost of the clips becomes an item of substantial importance. Another item of importance is the weight of the clips, since the clips must be transported from the manufacturer to the distributor, and subsequently to each job or construction site. The lighter the clip, the less the freight costs.

Another consideration which is of prime importance is the ability of the clip to withstand the pressures applied by the forms in response to the force exerted on the forms by the concrete as the concrete is poured. The viscous concrete is extremely heavy and as it is initially poured, a substantial force is applied to the clips at the outer portion of the clips between the base portion and the vertically extending portion. If the clip fails, there obviously is an accompanying distortion in the form and a blow out of the concrete material. Not only must the concrete material be cleaned up as rapidly as possible, but also the forms must be re-built and the step repoured. Both time and material are lost.

A failure of the forms which results in a blow out is usually the result of the failure of the clips to withstand a pressure surge from the concrete being poured. The surge in pressure lasts less than one second, and it must be absorbed by the forms and the clips or stakes supporting the forms. Once the surge is over, the weight of the concrete must be supported by the forms, clips, etc. The surge is a function of the height from which the concrete is poured and the weight of the concrete, in terms of vertical height. If clips fail due to the pressure surge, the blow out will either accompany the surge or will follow shortly thereafter as the weight of the concrete is hydraulically transmitted to the forms and clips. Such a situation is to be avoided, if possible.

The clip disclosed in the '567 patent, made of a single piece of strap material, such as steel strap, is relatively heavy since it is made of a solid material. The foundation clip of the '397 patent comprises parallel wires, and is lighter than the '567 clip. Since the wire of the '397 clip is duplicated or doubled, a cost factor is increased over the use of a single length of wire, as disclosed herein. Moreover, since the end pieces are a continuation of the parallel wires, no reinforcement is provided. A failure at the corners of the clip is accordingly possible without such reinforcement. The present clip is about 60% lighter than the prior art clip, patterned after the '567 apparatus, and about 25% stronger due to the end or corner reinforcing elements.

The apparatus of the present invention includes a single base element with reinforced ends. For alignment purposes, outwardly extending tabs with nail holes extending through the tabs are provided. The nail holes allow the clips to be located specifically along chalk lines outlining the stem by alignment of the tab edges along the lines. Nails are then used to secure the clips, as aligned, in place. Neither the '567 clip nor the '397 clip include any provisions for the alignment of the clips which in turn align the foundation walls. Rather, extra time must be spent in aligning the concrete forms and the clips when either the '567 or the '397 clips are used.

A further convenience with the apparatus of the present invention is color coding. Plastic end pieces, which include the tabs, are secured to the wire base and end portions. The end pieces are color coded for identification of the length of the clips for different width concrete stems and for different thickness of plywood used for the forms. Prior art clips are easily lost because they blend in with the construction residue, refuse, etc. It is also time consuming to identify clips of different sizes. These problems are overcome by the apparatus of the present invention.

SUMMARY OF THE INVENTION

The invention described and claimed herein comprises a foundation clip having a single base element and a pair of reinforced end elements for positioning and holding concrete forms.

Among the objects of the present invention are the following:

To provide new and useful clip apparatus;

To provide new and useful clip apparatus for spacing apart concrete forms;

To provide new and useful clip apparatus having alignment tabs for aligning the clips along a predetermined line;

To provide new and useful clip apparatus having color coded elements for identification purposes;

To provide new and useful clip apparatus having a single base element;

To provide new and useful clip apparatus easily aligned for holding concrete forms;

To provide new and useful clip apparatus including a base element and reinforced end elements;

To provide new and useful clip apparatus for spacing apart a pair of parallel forms for structural concrete work; and To provide new and useful foundation clip apparatus which is relatively light weight and relatively inexpensive.

BRIEF DESCRIPTION OF THE DRAWING

FIG. 11 is a perspective view of an alternate embodiment of the apparatus of the present invention.

FIG. 12 is a view in partial section of the apparatus of FIG. 11, taken generally along line 12—12 of FIG. 11.

FIG. 13 is a perspective view of an alternate embodiment of the apparatus of FIG. 13.

FIG. 14 is a bottom perspective view of the apparatus of FIG. 13.

FIG. 15 is a view in partial section of the apparatus of FIGS. 13 and 14.

DESCRIPTION OF THE PREFERRED EMBODIMENT

Figure 1:
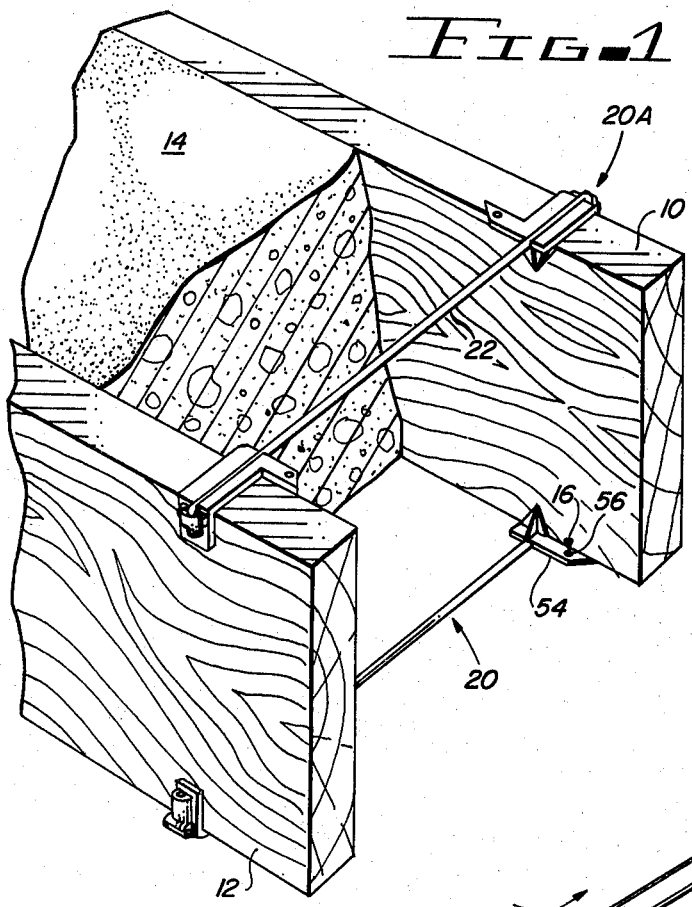
FIG. 1 is a perspective view illustrating the apparatus of the present invention in its use environment.
Figure 3:
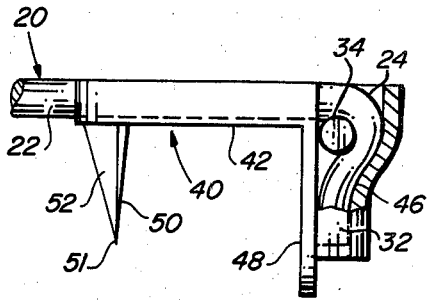
FIG. 3 is a side view of a portion of the apparatus of FIG. 2.
Figure 2:
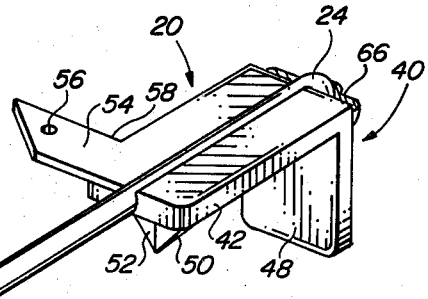
FIG. 2 is a perspective view of the apparatus of the present invention.
Figure 4:
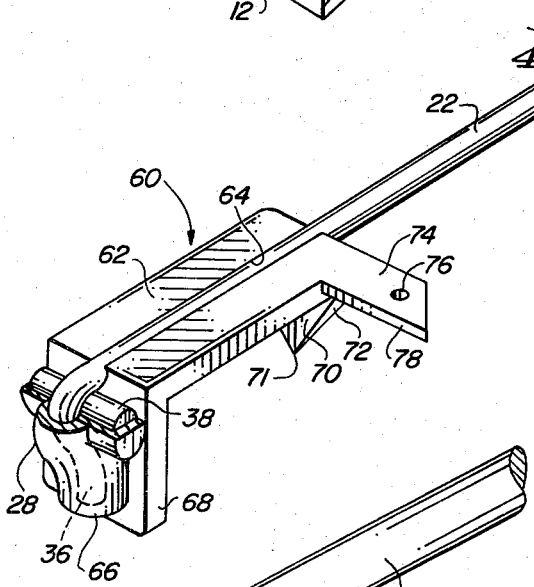
FIG. 4 is a view in partial section taken generally along line 4—4 of FIG. 2.
Figure 4:
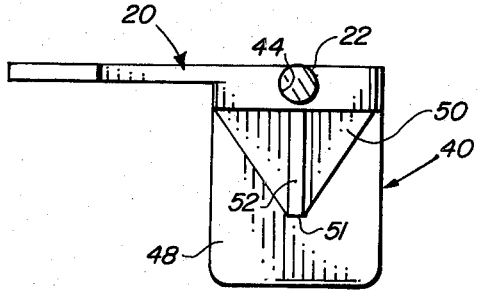
Figure 5:
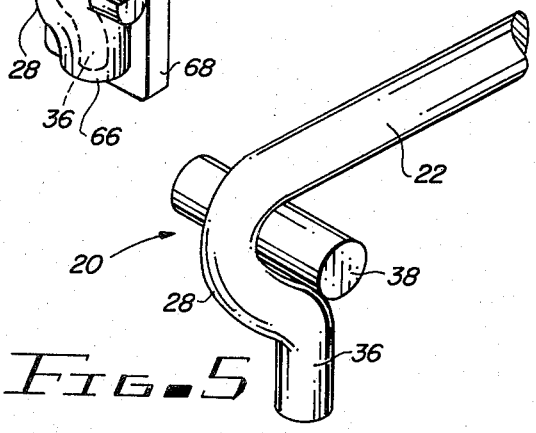
FIG. 5 is an enlarged perspective view of one end of a portion of the apparatus of the present invention.
Figure 6:
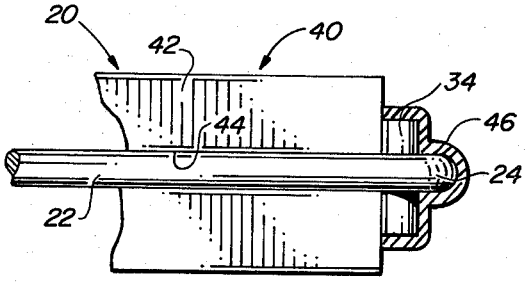
FIG. 6 is a bottom plan view of the apparatus of the present invention.

FIG. 1 is a perspective view of clip apparatus 20 illustrating the use of the clip apparatus in its use environment. FIG. 2 is a perspective view of clip apparatus 20 of the present invention. FIG. 3 is a side view of a portion of the apparatus of FIG. 2. FIG. 4 is a view in partial section of the clip 20 of FIG. 2, taken generally along line 4—4 of FIG. 2. FIG. 5 is a perspective view of a portion of the clip 20. FIG. 6 is a bottom plan view of a portion of the clip 20. For the following discussion, reference will be made to FIGS. 1 through 6.

The clip 20 of the present invention comprises a clip for holding together, in a spaced apart relationship, a pair of forms 10 and 12 used for pouring concrete. In FIG. 1, the pair of forms 10 and 12 are shown in spaced apart relationship, and maintained in such relationship by a pair of clips 20. The forms 10 and 12 are vertically extending and are generally parallel to each other. A bottom clip 20 is shown in a generally vertically parallel relationship with a second or upper clip 20A. The forms 10 and 12 are used to contain a quantity of concrete 14. When the concrete 14 cures, the forms 10 and 12 are removed and are used again, as needed. The upper clip 20A is removed from the forms 10 and 12 before the forms can be removed from the hardened, or at least partially cured, concrete 14. The bottom clip 20, which is in direct contact with the concrete 14 when the concrete is poured, obviously cannot be removed and is therefore expendable. However, the upper clip 20A can be removed and accordingly is reusable. A plurality of clips are used with the forms, and the clips are appropriately spaced apart at predetermined intervals, depending primarily on the height and width of the concrete stem which is poured between the forms.

Since the concrete is poured in various widths, depending on the type of structure ultimately to be built, and the forms vary in width, the clips come in various sizes. Obviously, different size clips cannot be used at the same time on the same forms. A color coding is used to identify clips of various lengths, and such will be discussed below.

Each clip 20 includes a single longitudinally extending wire base 22. The ends of the clips include vertically extending curved portions 24 and 28 which comprise transitions between the longitudinally extending base portion 22 and vertical end portions 32 and 36. Disposed within the curved portions 24 and 28 are a pair of cross members 34 and 38, respectively. The cross members provide lateral support. The cross members cooperate with the vertical end members to provide structural strength for the form clips 20. The radius of curvature of the curved portions 24 and 28 is substantially the same as the curvature of the wire out of which the apparatus is made. Accordingly, the lateral support cross members 34 and 38 are disposed against or within the curved portions for a substantial arcuate distance, and are aligned to a common plane, as best shown in FIG. 3. The curved portions 24 and 28 provide additional strength to the form clip 20 by providing a contact area of about 180° between the respective cross members and the curved portions. A spot weld extending through a cross member and its adjacent curved portion accordingly defines a maximum area of contact for the weld itself.

For making contact with the forms, which are generally made of wood, typically three quarters or one and one-eighth inch plywood, the form clips 40 include plastic form holders on each end. For the clip 20 of FIG. 2, a pair of substantially identical form holders 40 and 60 are shown. The form holder 40 includes a generally flat portion 42 which is aligned parallel to the base 22. The base 42 includes a groove 44 which receives, and into which snaps, the end or outer portion of the wire base 22 and the adjacent end portion, including the curved portion 24, the transverse or cross member 34, and the vertical end portion 32. Extending at generally a right angle, or perpendicularly, to the base 42 is an outer end section 46 which includes an inner relieved portion into which the cross member 34 and the vertical end member 32 and the curved portion 24 extends. The end 46 includes an outer wall portion 48. Spaced apart from the outer wall 48 is an inner wall 50. The inner wall 50 includes a gusset 52 remote from the outer wall 48. The gusset 52 provides structural strength for the inner wall 50. The wall 48 is substantially perpendicular to the bases 42 and 22, and parallel to the element 32.

The inner wall 50 is of a generally triangular configuration, extending from its base at the base 42 and extending upwardly to a tip 51 remote from the base 42. The triangle base is on the base 42 and it extends substantially across the full width of the base 42, as best shown in FIG. 4.

As best shown in FIG. 3, the inner wall 50 is disposed at an obtuse angle with respect to the outer wall 48. That is, the walls 48 and 50 are not parallel with each other. Rather, there is an angular difference of slightly greater than 90°, or about 97°, between the inner wall 50 and the base 22 of the clip 20 and the base 42 of the form holder 40. The spacing between the outer wall 48 and the juncture of the inner wall 50 with the base 42 is substantially the width of a form, such as the forms 10 and 12 of FIG. 1. However, the angular orientation of the wall 50 defines the spacing between the tip 51 and the wall 48 to be greater than the spacing between the two walls at the base 42. This allows the clips to be easily and quickly secured to the forms and allows the clips to be easily removed from the forms, as in the case of clip 20A of FIG. 1. There is preferably about a seven degree declination between the inner wall 50 and a vertical or perpendicular alignment from its juncture at the base 42 which provides an angular orientation of about 97° between the base 42 and the inner wall 50.

The form holder 40 includes two main portions, a first portion associated with the base 22 and a second portion associated with the end 32. The first portion includes the base 42, inner wall 50, and tab 54, as their associated elements. The second portion is a sleeve fitting over the end 32 and cross member 38 and includes the outer wall 48.

The form holder 60 is substantially identical to the form holder 40. It includes a base 62 with a groove 64 therein for receiving the wire base 22 and the outer end of the clip wire base. An outer end 66 includes an outer wall 68 which is spaced apart and extends inwardly facing an inner wall 70. The inner wall 70 includes an exterior gusset 72, which is integral therewith, and which extends from the base 62 to a tip 71 of the triangular inner wall 70.

Extending outwardly from the form holders 40 and 60 are tabs 54 and 74, respectively. The tabs extend substantially perpendicularly outwardly from the longitudinal axis of the wire base 22. Apertures 56 and 76 extend through the tabs 54 and 74, respectively. The purpose of the tabs is to enable the form clips to be aligned at the location at the edge of concrete to position the forms properly. Accordingly, the driving a nail 16 through the aperture 56 in the tab 54 of the clip 20, as shown in FIG. 1, the clips may be secured in position at specific locations. The alignment of the clips is best shown in FIG. 1, where the tab 54 is shown adjacent to and aligned with the form 10.

The tabs include an inner edge which is substantially perpendicular to the longitudinal axis of the base (22) of the clip and of the base (42, 62) of its form holder. The form holder 40 includes an edge 58 and the form holder 60 includes an edge 78 of their respective tabs 54 and 64. In FIG. 1, the edge 58 of the tab 56 is disposed against the form 10. In locating the clips 20, the edges of the tabs are aligned with a string, chalk line, or the like.

In FIGS. 2 and 6, portions of the plastic form holders 40 and 60 are sectioned for clarity, showing the cross or transverse reinforcing elements extending into the form holders.

Figure 7:
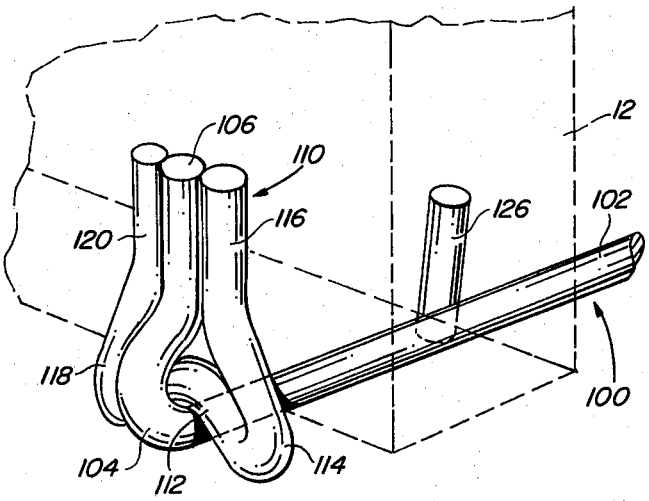
FIG. 7 is a perspective view of an alternate embodiment of the apparatus of the present invention.
Figure 8:
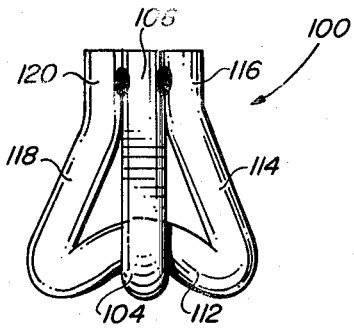
FIG. 8 is an end view of the apparatus of FIG. 7.
Figure 9:
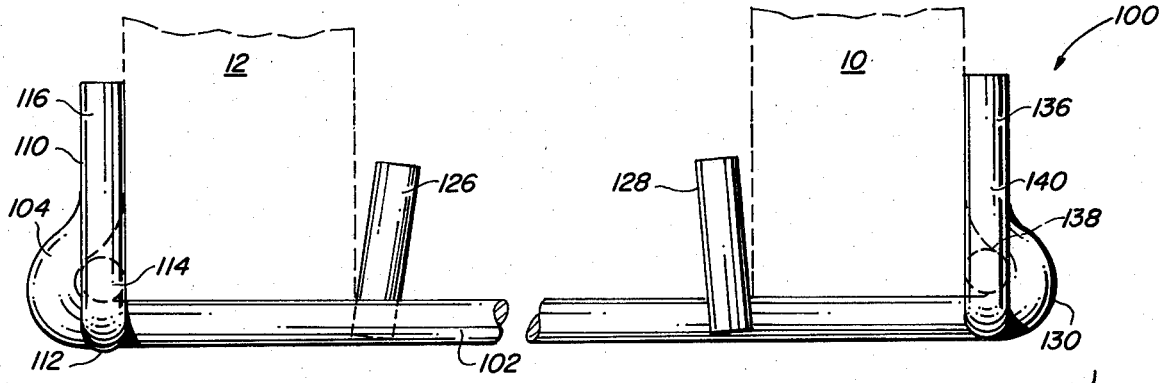
FIG. 9 is a side view of the apparatus of FIGS. 7 and 8.
Figure 10:
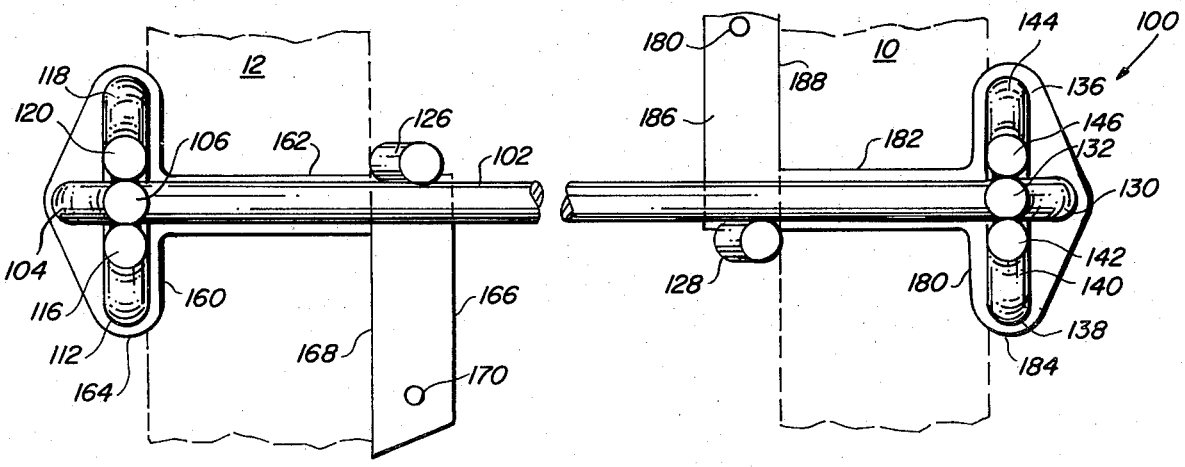
FIG. 10 is a top view of the apparatus of FIG. 9.

FIG. 7 is a perspective view of a portion of an alternate embodiment of the apparatus of FIGS. 1–6, comprising a foundation clip 100. FIG. 8 is an end view of the foundation clip 100 of FIG. 7. FIG. 9 is a side view of the clip 100 illustrating its use, with a pair of forms 10 and 12 shown in phantom in place on the clip 100. FIG. 10 is a top view of the apparatus of FIG. 9. For the following discussion concerning the clip 100, reference will be made to FIGS. 7, 8, 9, and 10.

The clip 100 of FIGS. 7–10 is similar to the clip 20 of FIGS. 1–6 in that it includes a longitudinally extending wire base member 202, which is substantially identical to the wire base member 22 of FIGS. 1–6. At each end of the base member or element 202 is a curved portion which extends about a transverse or laterally extending portion of an end member. At one end of the base element 102 is a curved portion 104, the radius of curvature of which is substantially identical to the diameter of the wire out of which the base member and the other members of the clip 100 is fabricated. A curved portion 130 is disposed at the opposite end of the base element 102 from the curved portion 104.

The curved portion 102 terminates in an upwardly or vertically extending portion 106. The curved portion 130 terminates in a vertically or upwardly extending portion 132. The vertical portions 106 and 132 are substantially perpendicular to the base element 102. At the ends of the base element 102, and disposed adjacent the curved portions and the vertically extending portions of the clip 100 are a pair of end members 110 and 136. The end member 110 includes a curved base portion 112, the center of which is disposed within the curved portion 104 of the base 102. The curved portion 104 of the base 102 and the curved portion 112 of the end 110 are appropriately secured together, as by spot welding, as discussed above with respect to the curved portion 28 of the clip 22 and its transversely extending reinforcing element or member 38, and the curved portion 24 and its transversely extending element 34, as discussed above and as shown best in conjunction with FIGS. 2, 3 and 5.

In addition to the curved base portion 112, the end member 110 includes a lower leg 114 and a lower leg 118, both of which extend inwardly and upwardly from the base member 112 from a location laterally or transversely outwardly from the base element 102 to a location adjacent the juncture of the curved portion 104 and the vertically extending portion 106 of the base 102. The end member 110 terminates in a pair of upwardly extending arms 116 and 120, best shown in FIG. 8. The upper arms 116 and 120 are substantially parallel to and aligned with the vertical portion 106 of the base 102. The three elements 106, 116, and 120 are also preferably secured together in an appropriate manner, as by spot welding.

From the curved portion 104, the base 112 of the end member extends outwardly and downwardly on both sides of the base 102. From an outer point, or a pair of points spaced apart from the base 102, the end member curves and then extends upwardly and inwardly to define the lower leg members 114 and 118. The end member then terminates in the vertically extending upper arm portions 116 and 120.

It will be noted that the end member 110 is preferably made of wire of the same diameter or gauge as the base 102.

The end member 136 is substantially identical to the end member 110. It includes a base portion 138 which is curved over the base element 102 and disposed within the curved portion 130 of the base 102. The base 138 then extends outwardly and downwardly from the base element 102 a predetermined distance which is substantially the diameter of the wire out of which the clip 100 is made. The base member 138 then is curved upwardly and inwardly to define a pair of lower legs 140 and 144. The lower legs 140 and 144 extend inwardly and upwardly to join the vertically extending portion or element 132 of the end of the clip, which is an extension of the base 102. The base member 138 then terminates in a pair of vertically or upwardly extending upper legs or elements 142 and 146 which are aligned with the vertically extending element 132, in an alignment which is substantially parallel to the alignment of the elements 106, 116, and 120. The elements 132, 142, and 146 are also appropriately secured together, as by spot welding. The respective end elements are substantially perpendicular to the longitudinally extending base portion 102.

The three vertically extending elements at the ends of the base 102 comprise end walls for forms, such as the forms 10 and 12 shown in phantom in FIGS. 7, 9, and 10. The respective elements correspond to the outer end walls 48 and 66 of the form clip 20 of FIGS. 1-6. The three elements at each end thus comprise an outer end wall for the forms 10 and 12.

Spaced apart from the respective end walls of the clip 100 are a pair of inner wall or support elements 126 and 128. The element 126 is spaced apart from the end elements 106, 116, and 120, and the element 128 is spaced apart from the end wall elements 132, 142, and 146.

As best shown in FIG. 9, the inner support elements 126 and 128 are not perpendicular to the base element 102, but rather are disposed at an obtuse angle with respect to the base member from the respective end members. An angular orientation of about seven degrees from the perpendicular is preferable. The seven degree angular orientation has been discussed, above, with respect to the inner walls 50 and 70 of the clip apparatus 20. The distance between the respective outer end wall elements and the juncture of the inner support elements 126 and 128 with the base 102 is substantially the width of the forms, such as the forms 10 and 12, to which the clip apparatus 100 will be secured. However, the distance between the end members and the upper ends of the inner support elements 126 and 128 is slightly greater than the width of the form members to allow for ease of installation and removal of the clip apparatus 100 from the forms. This is best shown in FIG. 9, in which the forms 10 and 12 are shown in phantom in conjunction with the clip 100.

The support elements 126 and 128 are made of the same gauge wire as the rest of the clip apparatus 100. The elements 126 and 128 are secured to the base 102 on opposite sides thereof, by appropriate means, such as spot welding.

The clip apparatus 100 is advantageous in that it is fabricated of only a single material, namely steel wire, and accordingly is relatively light weight and easily transported due to the lack of bulk. The wire out of which the clip apparatus is formed is relatively easily curved or bent to the desired shape, and it lends itself well to spot welding techniques for securing the various elements together to comprise the finished clip apparatus 100.

A plastic tab element, similar to the tabs of the end support elements 40 and 60 of FIGS. 1-6 may be used with the clip apparatus 100. However, since no inner support wall, like the walls 50 and 70 of the elements 40 and 60, are required, the plastic elements need only include a base portion with a groove to receive the wire base element 102 and an end portion to receive a part of the end wall element. A pair of such tab elements 160 and 180 are shown in FIG. 10 outlined about the ends of the clip 100, with forms 10 and 12 shown in phantom.

The tab element 160 includes a base portion 162, an end portion 164, and a tab portion 166. The tab portion 166 includes an aperture 170. The tab element 180 includes a base portion 182, an end portion 184, and a tab portion 186. An aperture 190 extends through the tab portion 186. The tabs 166 and 186 include alignment edges 168 and 188, respectively, for alignment of the clips for receiving the concrete forms, as shown in phantom in FIG. 10.

An alternate embodiment of the apparatus of the present invention is shown in FIGS. 11 and 12. FIG. 11 is a perspective view of a portion of a clip apparatus 200. FIG. 12 is a view in partial section of the apparatus of FIG. 11 taken generally along line 12—12 of FIG. 11.

For the following description of the clip apparatus 200, reference will be made to FIGS. 11 and 12.

While the clip apparatus 20 and clip apparatus 100 of FIGS. 1-10 are advantageous in certain respects, there are also advantages to having a clip apparatus capable of being molded from polymerizing materials, such as various types of plastic materials. Clip apparatus 200 of FIGS. 11 and 12 illustrates one such type of form clip capable of being molded. The clip apparatus 200 includes a single relatively flat base element 202. On both ends of the base element 202 are end members. An end member 204 is shown in FIG. 11. The end member at the opposite end of the base element 202 from the end member or element 204 is substantially identical to the end member 204, and accordingly is not shown and will not be discussed herein.

The end member 204 includes the vertically extending wall 206 which includes a generally flat face 208 substantially perpendicular to the base element 202. The vertical wall 206 is spaced apart slightly from an outer or distal end 210 of the base 200. The purpose for the spacing between the wall 206 and the outer or distal end 210 of the base 202 is to accommodate a plurality of reinforcing gussets, namely gussets 212, 214, and 216. The gussets are triangularly shaped plates formed integrally with the base 202 and the vertical wall 206. Their purpose is to reinforce and strengthen the vertical wall 206 with respect to the base 202.

Since the polymerized material out of which the clip apparatus is made is not as strong as the steel wire out of which the clips 20 and 100 are made, the reinforcing gussets 212, 214, and 216 are needed to prevent the clip apparatus 200 from failing during the pouring of the cement materials. (See FIG. 1.)

The weight of cement is well known and understood, and during the pouring and initial curing of the concrete, pressure forces are directed against the sides of the concrete forms 10 and 12, as shown in FIG. 1, and the strength of the clip apparatus used to secure the forms together must be strong enough to withstand the outwardly exerting pressure of the concrete, including the momentary surge of pressure discussed above. Once the concrete begins to cure, the outwardly pushing force or pressure is alleviated to a certain extent. Accordingly, the greatest stresses imposed on the clips, and on the concrete forms, are during the pouring stages of the concrete and during the first portions of the curing period. The ends of the clips, in the embodiments of FIGS. 1–10 and 11–15, are reinforced to withstand the stresses.

A slot 218 is disposed between the first outer gusset 212 and the central gusset 214. A second slot 220 is formed between the center gusset 210 and the second outer gusset 216. The slots 218 and 220 extend upwardly from the base element 202 between the respective gussets.

Spaced apart from the vertical wall 206 of the end member 204 is an inner wall 230. The inner wall extends from the base 202 upwardly and rearwardly, away from the wall 206, and terminates in a tip 232. The inner wall 230 includes a relatively smooth or planar face 234 which is generally facing toward the vertical wall 206 and which is of a generally triangular configuration, with its base at or on the base 202.

The face 224 extends away from the vertical wall 206 at an angle for ease of installation and removal of the clip 202, as discussed above. The angular orientation of the front face 224 of the inner wall 220 from the vertical is illustrated in FIG. 11 by an angle alpha. The angle alpha is preferably about seven degrees, as discussed above in conjunction with the clips 20 and 100. A triangular reinforcing gusset 236 extends from the base 202 upwardly towards the tip 232 for strengthening the inner wall 230. The gusset 236 is disposed against the rear or back of the wall 230, remote from the face 234.

An alignment tab 240 extends outwardly from the base element 202, substantially perpendicular thereto. The tab 240 includes an aperture 242 extending through the tab and an alignment edge 244. The alignment edge 244 is preferably aligned with the juncture of the base 202 and the face 234 of the inner wall 230. The tab 240 is substantially identical to the tabs discussed above in conjunction with the clips 20 and 100 of FIGS. 1–11.

While the clip apparatus 200 as illustrated in FIG. 13 may be substantially strong enough to withstand the pressure of concrete, it may be desirable to change the configuration slightly by providing a solid end member, reinforced with a different polymer material than that from which the clip is made. Such an embodiment is shown in FIGS. 13, 14, and 15. FIG. 13 is a perspective view of a portion of an alternate embodiment of the clip apparatus 200 shown in FIGS. 11 and 12. FIG. 14 is a bottom perspective view of the apparatus of FIG. 13. FIG. 15 is a view in partial section of the apparatus of FIG. 13, taken generally along line 15—15 of FIG. 13.

A portion of a foundation clip 300 is shown in FIGS. 13, 14, and 15. The clip 300 includes a single base member or element 302 and an end member or element 304. The end member 304 extends from one end 310 of the base 302 upwardly. The end member includes a face 306 against which one side of a concrete form is disposed. The face 306 is generally flat or planar and is substantially perpendicular to the base 302.

The end member 304 also includes a reinforcing buttress 308 which extends from the end 310 to the face 306. Within the buttress 308 of the end member 304 is a pair of bores 312 and 314, best shown in FIG. 14. The bores 312 and 314 extend upwardly from the bottom surface of the base element 302.

FIG. 15 shows the bore 314 filled with a plug 318 of a different type of plastic, preferably, from that out of which the base 302 and the end member 304 is made. Both bores 312 and 314 are plugged, of course.

The clip apparatus 300 may be molded out of relatively inexpensive plastic material which does not have the strength of more expensive materials. However, a second molding operation allows the bores 312 and 314 to be filled with a stronger, more expensive material which provides the necessary strength to allow the clip 300 to withstand the pressure, including the initial surge, of concrete.

An alignment tab and inner wall, spaced apart from the end member 304, are not shown in FIGS. 13, 14, and 15. Neither is the opposite end of the clip apparatus 300.

The clips 200 and 300 may be appropriately color coded, as discussed above. An advantage of the clips 200 and 300 is that an entire clip is color coded, rather than only the outer portions, the plastic form holders, of clips 20 and 100.

The corner or end reinforcing elements of the embodiments of FIGS. 1–11 provide a time delay factor in case of a concrete overload to prevent a blowout. The transverse reinforcing elements, as welded (secured) to the curved portions of the vertical end members, provide a double safety factor. The first safety factor is the strength in the weld between the transverse element and the end member. The time required for destruction (tearing) of the weld is generally greater than the surge pressure time. Accordingly, by the time a weld fails, the surge pressure has diminished and the second safety factor takes over to withstand the balance of the surge pressure plus the regular static pressure of the concrete. The second safety factor lies in the curved portion and in the vertical portion of the end members, themselves.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Form clip apparatus for securing together in a spaced apart relationship a pair of concrete forms comprising, in combination:

base element means having a single structural member;

first outer end means secured to the base element means and extending substantially perpendicularly thereto;

second outer end means secured to the base element means remote from the first outer end means and extending substantially perpendicularly to the base element means;

first inner support means secured to the base element means and spaced apart from the first outer end means, the first outer end means and the first inner support means adapted for receiving and supporting a portion of a first concrete form therebetween;

a second inner support means secured to the base element means and spaced apart from the second outer end means for receiving a portion of a second concrete form therebetween for holding the first and second concrete forms in a spaced apart relationship; and alignment tab means secured to the base element means adjacent the first and second inner support means for aligning the first and second concrete forms in a predetermined relationship.

2. The apparatus of claim 1 in which the base element means comprises a single wire element; and the first outer end means and the second outer end means comprise continuations of the single wire element, each having a portion extending upwardly substantially perpendicularly to the base element means.

3. The apparatus of claim 2 in which the first and second outer end means each include a curved portion having a radius of curvature substantially the same as the diameter of the wire of the base element means and disposed between the base element means and the upwardly extending portions.

4. The apparatus of claim 3 in which the first and second outer end means each include first and second reinforcing means, respectively, for reinforcing the upwardly extending portions of the outer end means.

5. The apparatus of claim 4 in which the first and second reinforcing means each include a portion disposed in the curved portions of the outer end means.

6. The apparatus of claim 5 in which the first and second reinforcing means include a pair of arms disposed substantially parallel to the upwardly extending portions of the outer end means.

7. The apparatus of claim 1 in which the outer end means include a color coded portion for identifying a particular form clip.

8. The apparatus of claim 1 in which the first and second outer end means each include a planar face.

9. The apparatus of claim 8 in which the first and second inner support means are disposed at an obtuse angle with respect to their adjacent planar faces and the base element means.

10. The apparatus of claim 9 in which the first and second inner support means each include a planar face.

11. The apparatus of claim 8 in which the reinforcing means of the outer end means includes gussets extending from the base element means to the planar faces.

12. The apparatus of claim 8 in which the reinforcing means of the outer end means includes buttresses extending from the base element means to the planar faces.

13. The apparatus of claim 8 in which the base element means includes a first sleeve secured to the first outer end means and a second sleeve secured to the second outer end means.

14. Form clip apparatus for securing together in a spaced apart relationship a pair of concrete forms comprising, in combination:

base element means having a single structural member;

first outer end means secured to the base element means and extending substantially perpendicularly thereto;

second outer end means secured to the base element means remote from the first outer end means and extending substantially perpendicularly to the base element means;

first inner support means secured to the base element means and spaced apart from the first outer end means, the first outer end means and the first inner support means adapted for receiving and supporting a portion of a first concrete form therebetween, a second inner support means secured to the base element means and spaced apart from the second outer end means for receiving a portion of a second concrete form therebetween for holding the first and second concrete forms in a spaced apart relationship; and reinforcing means secured to the base element means and to the first and second outer end means for reinforcing the first and second outer end means for holding the concrete forms.

15. The apparatus of claim 14 in which the reinforcing means comprises wire having a radius of curvature and disposed at the junctures of the base element means and the first and second outer end means.

16. The apparatus of claim 15 in which the first and second outer end means each have a curved portion with substantially the same radius of curvature as the wire, and a wire is disposed in each curved portion.

* * * * *